US010329806B2

(12) United States Patent
Scholz et al.

(10) Patent No.: US 10,329,806 B2
(45) **Date of Patent: *Jun. 25, 2019**

(54) CLOSING DEVICE FOR A MOTOR-VEHICLE HOOD, AND METHOD

(71) Applicant: Kiekert Aktiengesellschaft, Heiligenhaus (DE)

(72) Inventors: Michael Scholz, Essen (DE); Holger Schiffer, Meerbusch (DE); Omar Inan, Dorsten (DE); Thomas Hulsmann, Rohrmoos (DE)

(73) Assignee: Kiekert AG, Heiligenhaus (DE)

( * ) Notice: Subject to any disclaimer, the term of this patent is extended or adjusted under 35 U.S.C. 154(b) by 345 days.

This patent is subject to a terminal disclaimer.

(21) Appl. No.: 15/115,780

(22) PCT Filed: Feb. 2, 2015

(86) PCT No.: PCT/DE2015/000035

§ 371 (c)(1),
(2) Date: Aug. 1, 2016

(87) PCT Pub. No.: WO2015/113547

PCT Pub. Date: Aug. 6, 2015

(65) Prior Publication Data

US 2017/0009494 A1 Jan. 12, 2017

(30) Foreign Application Priority Data

Jan. 31, 2014 (DE) ..... 10 2014 201 799

(51) Int. Cl.
*E05B 81/20* (2014.01)
*E05B 77/08* (2014.01)
(Continued)

(52) U.S. Cl.
CPC ..... *E05B 81/20* (2013.01); *E05B 77/08* (2013.01); *E05B 81/16* (2013.01); *E05B 81/66* (2013.01);
(Continued)

(58) Field of Classification Search
CPC ..... E05B 81/20; E05B 77/08; E05B 81/16; E05B 81/06; E05B 81/66; E05B 83/24;
(Continued)

(56) References Cited

U.S. PATENT DOCUMENTS 4,982,984 A * 1/1991 Yokota ..... E05B 81/22 292/201
5,222,775 A * 6/1993 Kato ..... E05B 81/14 292/201
(Continued)

FOREIGN PATENT DOCUMENTS

DE 100 33 092 A1 1/2002
DE 10 2004 011 798 B3 10/2005
(Continued)

OTHER PUBLICATIONS

International Search Report and Written Opinion for corresponding Patent Application No. PCT/DE2015/000035 dated Jun. 22, 2015.

*Primary Examiner* — Nathan Cumar
(74) *Attorney, Agent, or Firm* — Renner, Otto, Boiesselle & Sklar, LLP

(57) ABSTRACT

The problem addressed by the invention is that of providing a closing device for a motor vehicle, by means of which a gap in a door or flap can be minimized. One aim in particular is to minimize the risk of injury. To solve this problem, a closing device comprises a locking mechanism that consists of a rotary latch and a pawl for locking said rotary latch in place. A drive is provided, with which said locking mechanism can be moved, totally or partially, by means of a pivot
(Continued)

Figure 1:
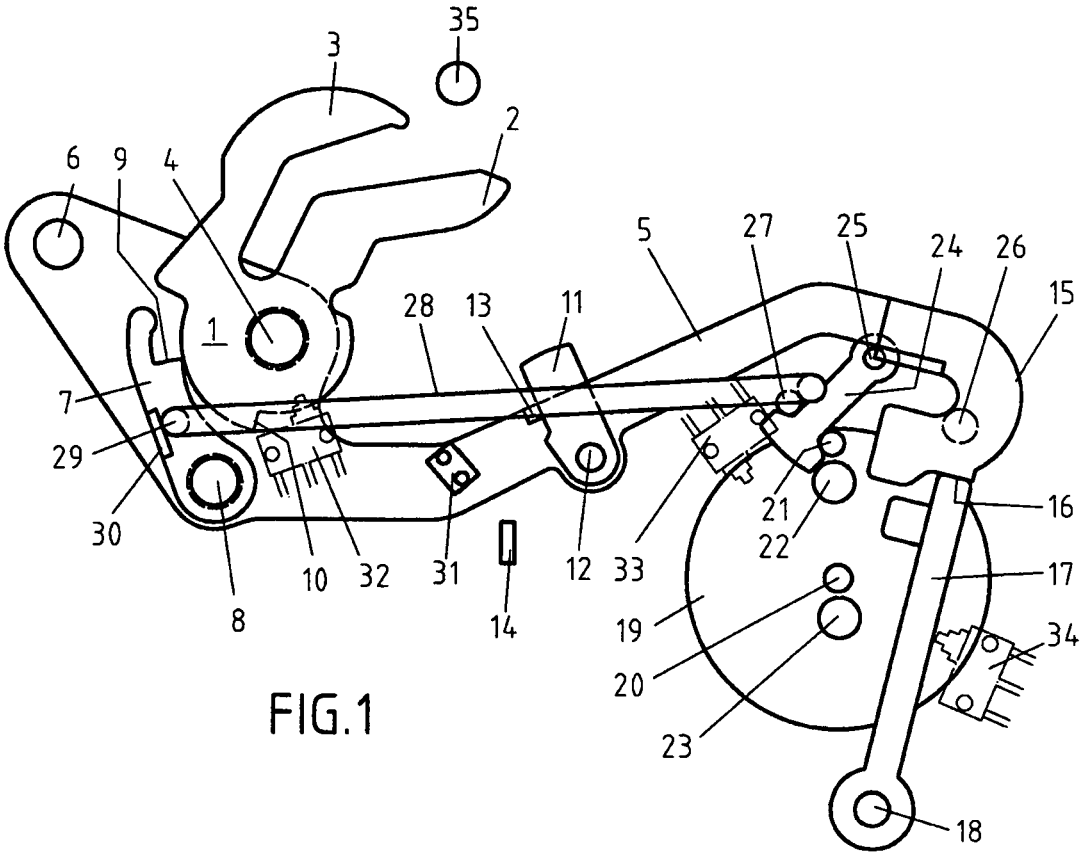

lever, also called a rocker, such that a gap in a door or flap can be reduced. Therefore, when a door or flap is closed, a gap initially remains between the door and doorframe, or between a frame and its associated flap. The drive allows the rocker, and therefore the locking mechanism or parts thereof, to be moved such that this gap is reduced. In order to minimize the weight and number of parts, the rotary latch and pawl are preferably rotatably secured to the rocker by means of shafts.

15 Claims, 3 Drawing Sheets

(51) Int. Cl.

| | |
|---|---|
| ***E05B 81/66*** | (2014.01) |
| ***E05B 83/24*** | (2014.01) |
| ***E05B 81/16*** | (2014.01) |
| *E05B 81/06* | (2014.01) |
| *E05B 81/14* | (2014.01) |
| *E05B 81/64* | (2014.01) |

(52) U.S. Cl.
CPC ..... *E05B 83/24* (2013.01); *E05B 81/06* (2013.01); *E05B 81/14* (2013.01); *E05B 81/64* (2013.01)

(58) Field of Classification Search
CPC ..... E05B 81/14; E05B 81/64; Y10T 292/696; Y10T 292/699; Y10T 292/702; Y10T 292/60; Y10T 292/1082; Y10T 292/1047; Y10S 292/26
USPC ..... 292/200, 201
See application file for complete search history.

(56) References Cited

U.S. PATENT DOCUMENTS

| | | | | | |
|---|---|---|---|---|---|
| 5,273,325 | A * | 12/1993 | Zimmermann | E05B 81/22 | 292/216 |
| 5,443,292 | A * | 8/1995 | Shimada | E05B 81/20 | 292/201 |
| 5,938,252 | A * | 8/1999 | Uemura | E05B 81/14 | 292/201 |
| 5,938,254 | A * | 8/1999 | Weyerstall | E05B 81/22 | 292/144 |
| 6,805,386 | B2 * | 10/2004 | Ehret | E05B 81/20 | 292/141 |
| 7,000,956 | B2 * | 2/2006 | Fisher | E05B 81/14 | 292/198 |
| 7,367,598 | B2 * | 5/2008 | Arabia, Jr. | E05B 81/22 | 292/201 |
| 7,938,458 | B1 * | 5/2011 | Zweibohmer | E05B 15/0006 | 292/197 |
| 7,954,898 | B2 * | 6/2011 | Van De Geer | B60N 2/01583 | 292/200 |
| 2003/0094820 | A1 * | 5/2003 | Erices | E05B 81/22 | 292/341.16 |
| 2007/0029814 | A1 * | 2/2007 | Coleman | E05B 81/14 | 292/201 |
| 2011/0260475 | A1 * | 10/2011 | Spurr | E05B 81/14 | 292/195 |

FOREIGN PATENT DOCUMENTS

| | | | | |
|---|---|---|---|---|
| DE | 10 2004 013 671 | A1 | 10/2005 | |
| DE | 10 2009 01818 | A1 | 11/2010 | |
| DE | 10 2013 109 051 | A1 | 2/2015 | |
| EP | 1489252 | * | 6/2003 | |
| EP | 1 489 252 | * | 12/2004 | E05B 81/20 |
| EP | 1 489 252 | A2 | 12/2004 | |
| WO | WO 2005/093195 | A2 | 10/2005 | |
| WO | WO 2015/024555 | A1 | 2/2015 | |

* cited by examiner

CLOSING DEVICE FOR A MOTOR-VEHICLE HOOD, AND METHOD

The invention relates to a latching device for a door or a flap and in particular for a hood of a motor vehicle with a locking mechanism comprising a catch and at least a pawl for latching of the catch. The latching device comprises a drive which moves the locking mechanism in such a way that a door gap or hood gap can be made smaller in the closed state of the door or flap.

The purpose of a latch or latching device of the type initially stated is for the temporary closure of openings in motor vehicles or buildings with the aid of doors or flaps. In the closed state of such a latch the catch encompasses a bracket-shaped locking bolt in particular with two arms (known as load arm and collecting arm). In the case of a motor vehicle, the locking bolt can be attached to a door or a flap of the motor vehicle and then the latch to the chassis or vice versa. The present invention is especially advantageous for front hoods or front flaps which are located at the front when viewed in the usual direction of travel of a motor vehicle.

Within the scope of the invention, the locking mechanism is regularly installed on the chassis side, is therefore attached to a pertaining motor vehicle chassis. In contrast, the locking bolt is connected to a hood. Consequently, a hood latch or motor hood latch is usually viewed.

If the catch of such a latch or latching device reaches a closed position by means of pivoting starting in an open position, the catch is ultimately latched by means of the pawl. Such a pivoting is attained by the locking bolt (also referred to as "latch holder") when it engages into the catch by closure of a pertaining door or flap. A locking area of the pawl is then adjacent to a locking area of the catch in the latched position, whereby the catch is prevented from being rotated back in the direction of the open position. The locking bolt can no longer leave the locking mechanism in the closed position.

For opening it is necessary to move the pawl out of its ratchet position. If the pawl is moved out of its ratchet position, the catch rotates in the direction of the open position. The locking bolt can leave the latch in the open position of the catch and thus in the open position of the locking mechanism. The door or flap can thus be opened again.

There are latches with two different ratchet positions of the catch. The catch can then initially be latched in the so-called pre-ratchet position and ultimately in the so-called main ratchet position by further rotation in the direction of the closed position.

DE 10 2008 005 181 A1 describes a latching aid to pull a flap or a door of a vehicle towards the motor vehicle chassis. The purpose of the known drive is to also open the door or flap. A combined closure and electrical opening of a tailgate latch arises from the publications DE 100 33 092 A1, DE 10 2004 011 798 B3 and DE 10 2004 013 671 A1.

There is an activation device in order to open the latch. If the activation device is activated, the locking mechanism opens. A door handle or flap handle can be part of the activation device. This handle is generally connected to an activation lever of the latch via a rod or a Bowden cable. If the handle is activated, the activation lever of the latch is pivoted in such a way by means of the rod or the Bowden cable that the latch opens. A motor vehicle can demonstrate an external handle which is generally pivotable which can be reached from the outside and/or a generally pivotable internal handle which can be reached from the inside.

If a locking mechanism of a motor vehicle is latched by closure of a door or a flap, a gap fundamentally remains between the door or flap and the adjacent chassis. Such a gap should be kept as small as possible especially for hoods located at the front when viewed from the usual direction of travel in order to prevent disadvantageous air turbulence in the front area and associated air resistance during a journey. However, a closed surface which is as gap-free as possible is also desired for optical reasons.

The German pre-registration DE 10 2013 109 051 deals with minimization of such gaps on doors or flaps. The known latch is mobile and in particular pivotably located. Following latching of the locking mechanism, the latch is moved or pivoted overall by a drive in such a way that a gap between the door or flap and chassis is minimized. The drive provided for this purpose comprises an electromotor and a pivotable lever which is known as a swing arm. By pivoting of the lever or the swing arm (hereinafter also known as a "swing lever") by the electromotor the latch overall is pivoted in such a way that the gap is minimized. The latch housing is held by a jack which is pivotably attached to the swing arm.

Insofar as not specified otherwise hereinafter, the object of the invention can demonstrate the aforementioned characteristics individually or in any combination.

It is the task of the invention to provide a further developed latching device with which a gap in a door or flap can be minimized. A particular objective is to minimize the risk of injuries.

In order to solve the task, a latching device encompasses the characteristics of claim 1. Advantageous designs result from the dependent claims.

A latching device for a door or flap demonstrates a locking mechanism comprising a catch and a pawl for latching of the catch. There is a drive with which the locking mechanism can be moved partially or completely using a swing lever, hereinafter also referred to as a swing arm, in such a way that a door gap or flap gap can be made smaller. If the door or flap is therefore closed, a gap initially remains between the door and the doorframe or between a frame and the pertaining flap. By means of the drive the swing arm and thus the locking mechanism or parts thereof can be moved in such a way that this gap decreases. In order to minimize the weight and the number of parts, the catch and the pawl are preferably pivotably attached to the swing arm by means of axes.

In one design, a retaining lever is attached to the swing arm to retain the catch and is preferably pivotably attached. This means that the catch can strike the retaining lever during a closure process in order to trigger an impact from the catch into the swing arm. This design contributes to the drive being protected from such impact forces and thus from damage.

In one design, the latching device is created in such a way that the pawl can only latch the catch when the catch has been retained by the retaining lever. This design contributes to a door gap or hood gap already being relatively small before the catch is latched. This contributes to preventing injuries due to trapped fingers and such.

In one design, the latch is created in such a way that the pawl can only latch the catch after the drive has pivoted the swing arm for reduction of a door gap or hood gap. This contributes to preventing injuries due to trapped fingers and such.

In one design, there is a control contour which is capable of pivoting the retaining lever out of its retaining position after the retaining lever has retained the catch. In a technically simple manner, a latch with advantageous characteristics can thus be provided with a small number of parts, which is capable of protecting in particular a drive for gap minimization from impacts and which is created in such a way that the risks of injury due to trapped fingers are prevented.

In one design, there is a control contour which is capable of pivoting the retaining lever out of its retaining position by pivoting the swing arm to reduce a door gap or hood gap or flap gap. In a technically simple manner, a latch or a latching device with advantageous characteristics can thus be provided with a small number of parts, which is capable of protecting in particular a drive for gap minimization from impacts and which is created in such a way that the risks of injury due to trapped fingers are prevented.

In one design, there is a rod which can be activated by a drive in order to move the pawl into or out of its ratchet position. This design enables suitable pivoting of the pawl. As a drive, a drive is envisaged in particular which is capable of pivoting the swing arm. The number of drives required is thus minimized. Alternatively, a control contour can be provided for with which the movement of the pawl in particular effected by pivoting movements of the swing arm can be suitably controlled. The pawl is in particular pre-tensioned by a spring in such a way that the pawl can be moved into its ratchet position by spring force.

In a technically simple design, the drive has a drive disk which is capable of pivoting the swing arm.

In one design, the drive disk possesses a protruding bolt, hereinafter also referred to as the first bolt, which restricts rotary movements of the drive disk. In particular, a rotation of the drive disk effects in this design causes the bolt to be moved against a stop in order to suitably limit rotary movements of the drive disk. The first bolt is in particular attached at the edge in order to enable compact construction space.

In one design of the invention, the stop for the first bolt is provided by a moving stop and in particular by a pivotably located lever. It is thus possible to enable rotary movements of the drive disk which are up to 360° and more despite the stop. The pivotably located lever preferably demonstrates a T-shaped end in order to act directly as a stop. The first bolt then reaches in particular into an angle of the T-shaped end when the drive disk is rotated as far as possible. There are preferably one or two further stops, for example in the form of bolts, which limit the pivoting movements of the pivotably located lever in order to provide a stop in a particularly reliable manner which is capable of suitably limiting the rotary movements of the drive disk.

In one design, the drive disk possesses a protruding bolt, hereinafter referred to as a second bolt, with which pivoting movements of the swing arm can be controlled by being supported. During a latching process, the swing arm is supported on the second bolt and preferably with an arched end. Rotary movements of the drive disk then enable movement of the second bolt. Thus, pivoting of the swing arm is enabled during a latching process for the purpose of making a gap smaller if the swing arm is supported on the second bolt. As the swing arm is only supported, it can be manually pivoted away from the bolt. The door or flap is therefore not closed with the force expended by the drive. Risks of injury are prevented if a finger is then located in the gap of a pertaining door or flap or hood.

In one design, a protruding bolt, hereinafter also referred to as a third bolt, is attached to the drive disk which can be moved into an arch-shaped end of the swing arm by rotating the drive disk in order to thus retain and pivot the swing arm. This design determines the position of the swing arm by the position of the bolt during a latching process when the bolt has been moved into the arch-shaped end. Manual movements of the swing arm by pivoting of a door or flap are then no longer possible. The door or flap can then be closed with the force expended by the drive. Thus, for example, against sealing pressure of a door seal or flap seal.

In one design of the invention, a pivoting of the swing arm in order to make the gap smaller is initially effected by the aforementioned second bolt and subsequently by the aforementioned third bolt. In a first phase, during making the gap smaller a finger located in the gap can therefore not be further trapped by the drive. Only when the gap has been made sufficiently smaller does the third bolt make the gap smaller and shut the door or flap.

In one design of the invention, there is preferably a pivotably attached bracing lever which is capable of bracing the swing arm when an impact is initiated in it due to a latching process. This design contributes to the drive being protected from such impact forces and thus damage. In order to suitably distribute loads for the purpose of damage prevention, the bracing lever in particular braces the pivotable end of the swing arm.

In one design of the invention, pivoting movements of the bracing lever are effected by a bolt, preferably by the stated second bolt, of the rotary disk. The bracing lever can thus be moved out of its bracing position at a suitable time in order to make the gap smaller by subsequent pivoting of the swing arm. The bracing lever is preferably pre-tensioned by a spring and namely in such a way that the bracing lever can be pivoted into its bracing position by spring force.

In one design of the invention the catch and pawl are arranged close to the axis around which the swing arm can be pivoted. The distance of the axes of the catch and pawl to the axis of the swing arm is therefore less than the distance between the axes of the catch and pawl to the end of the swing arm which is pivoted. A beneficial lever ratio is thus provided in order to be able to move the locking mechanism for example against sealing pressure with great force.

In one design of the invention, the catch can be pivoted away from the opening position when it is latched. If there are several ratchet positions, i.e. a main ratchet and a pre-ratchet, this applies to the main ratchet position. In particular, there is no stop which is capable of limiting this pivoting away from the (main) ratchet position if the locking bolt is moved beyond the envisaged latching position, i.e. opposite to the opening movement or in the direction of the overstroke position of the catch. Thus, risks of injury are prevented. If a person falls onto the systematically closed motor hood, the motor hood is also advantageously soft in the area of the latch in this execution form.

The latching device preferably possesses one or several microswitches with which positions of one or several components of the latching device can be ascertained. This is used in particular to suitably control the drive.

Figure 2:
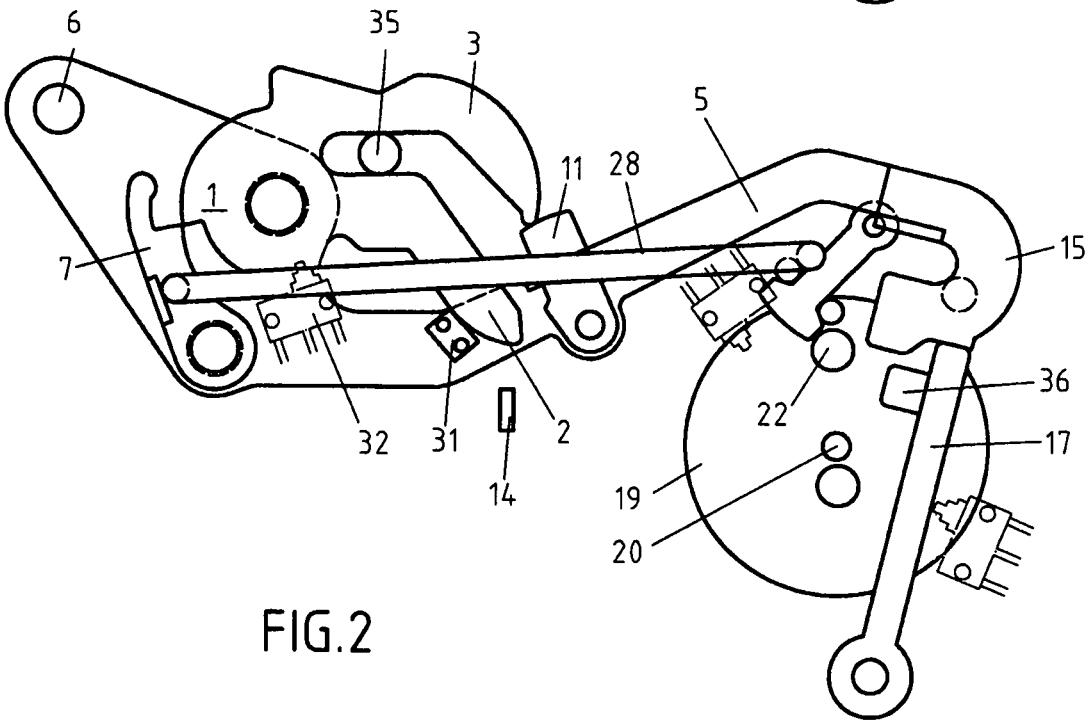
Figure 3:
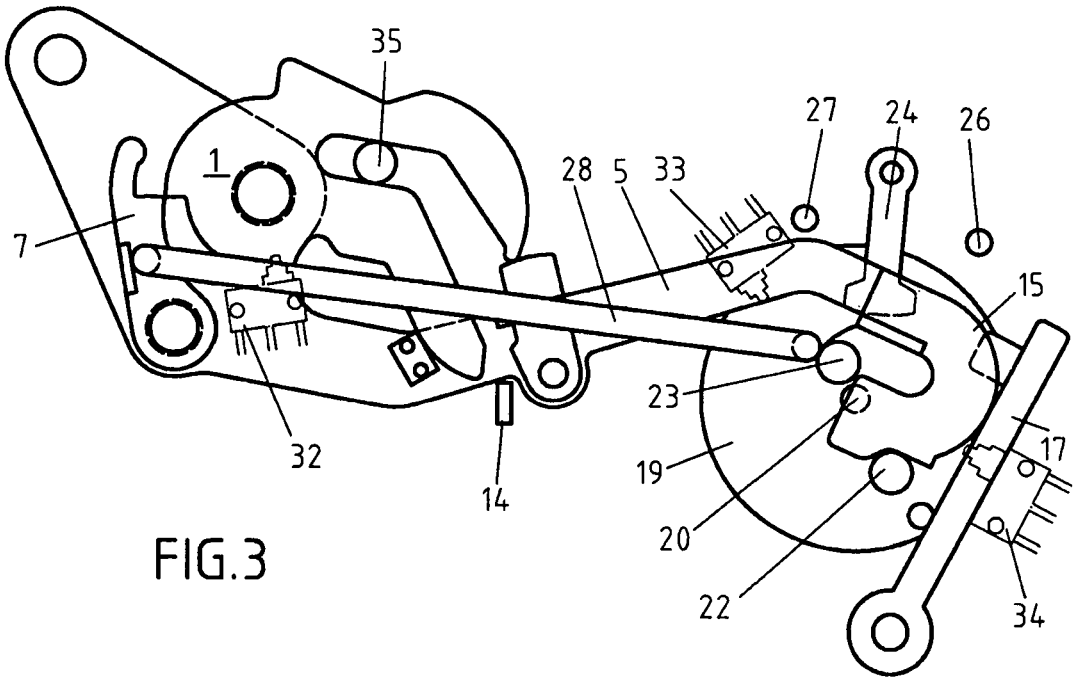
Figure 4:
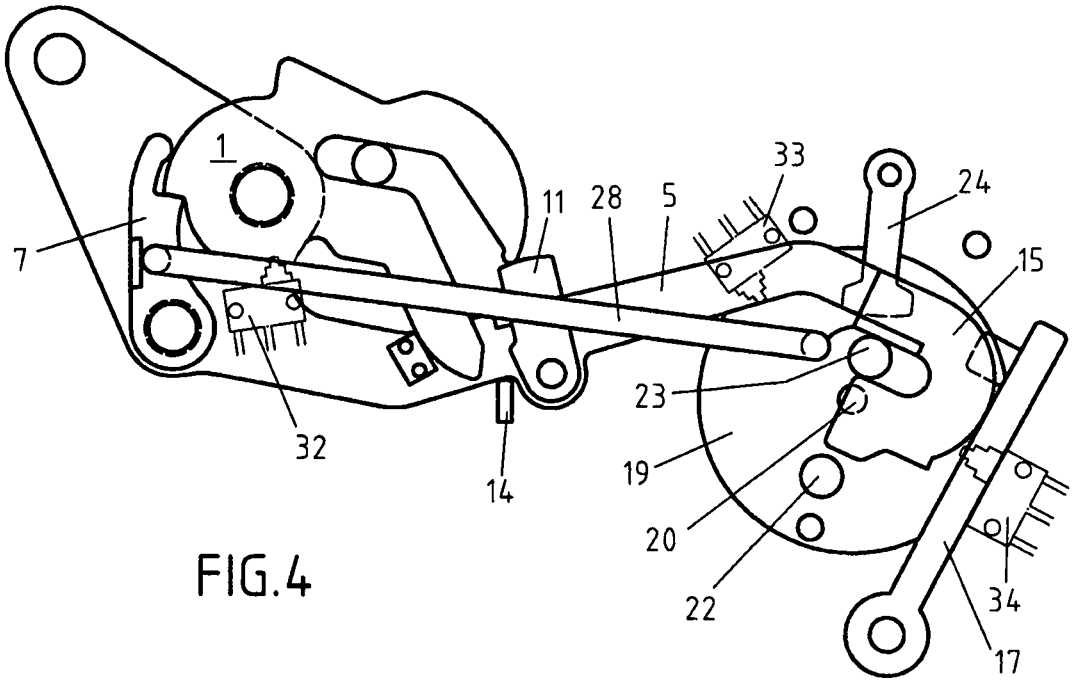
Figure 5:
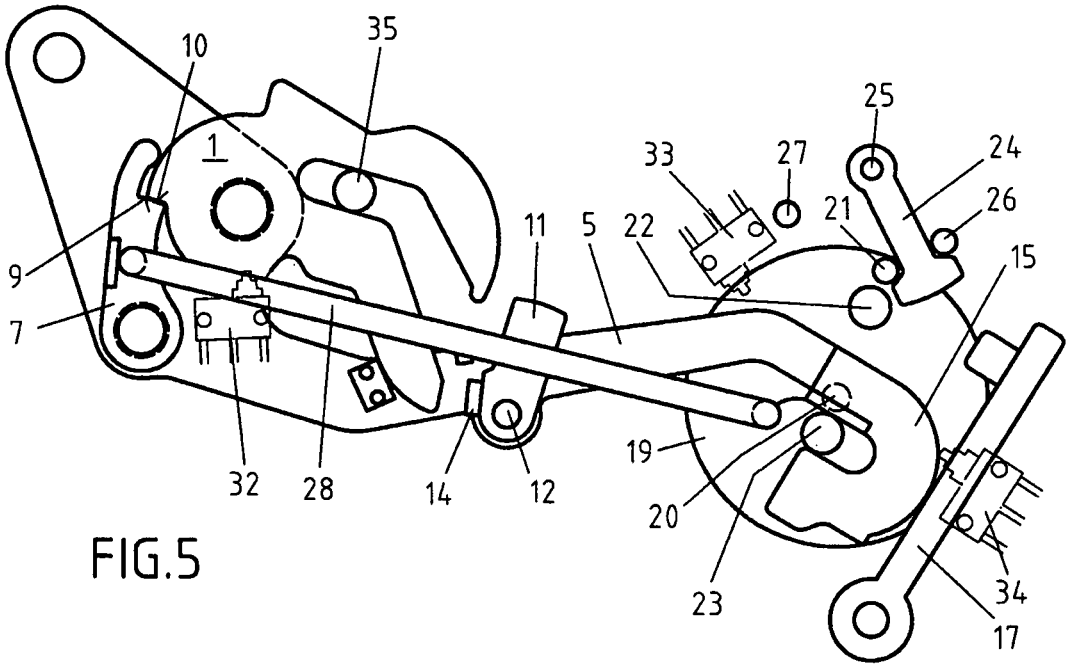
Figure 6:
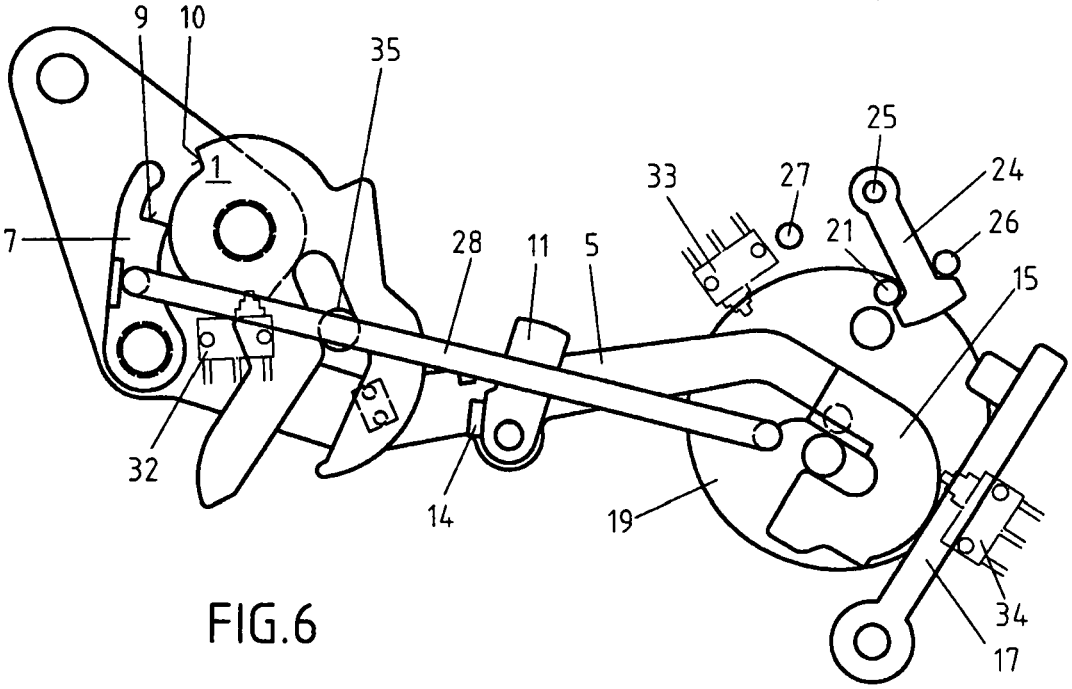

The following are shown:

FIG. 1: Latch in open position;

FIG. 2: First phase during a latching process;

FIG. 3: Second phase during a closure process;

FIG. 4: Third phase during a closure process;

FIG. 5: Latch in ratcheted position;

FIG. 6: Latch with catch in an overstroke position.

FIG. 1 shows a catch 1 with a collecting arm 2 and a load arm 3 in its open position. The catch 1 is pivotably attached with an axis 4 on a swing arm 5. The swing arm 5 can be rotated around its axis 6. The axis 6 is attached to a non-illustrated chassis directly or, for example, indirectly to the chassis of a motor vehicle via a non-illustrated latch plate. The catch can be latched by means of a pawl 7. The pawl 7 is pivotably attached to the swing arm 5 by means of an axis 8. The pawl 7 possesses a ratchet surface 9. This ratchet surface 9 is adjacent to the ratchet surface 10 of the catch 1 when the catch 1 is latched.

A retaining lever 11 is pivotably attached to the swing arm 5 with an axis 12 in a middle area of the swing arm 5. The retaining lever 11 acts as an impact absorber in order to protect the subsequently described drive unit from damage when the hood is closed.

The swing arm 5 is equipped with a protruding stop 13 which limits the pivoting of the retaining lever 11 in an anti-clockwise direction. The retaining lever 11 is preferably pre-tensioned by a non-illustrated spring so that this can be pivoted by pre-tensioning in the direction of the stop 13. A control contour 14 is attached to the latch plate or directly to the chassis. This controls the pivoting of the retaining lever 11.

In the shown open position of the locking mechanism, the pivotable, arch-shaped end 15 of the swing arm 5 is braced on a pivotable end 16 of a bracing lever 17. The bracing lever 17 is attached to a latch plate or directly to the chassis with an axis 18. The bracing lever 17 can be pivoted around the axis 18.

A drive disk 19 is pivotably located around its axis 20. The axis 20 is attached to a latch plate or directly to the chassis. A first bolt 21, a second bolt 22 and a third bolt 23 protrude from the drive disk 19. The three bolts 21, 22 and 23 and the axis 20 are preferably arranged roughly along a straight line in order to be able to utilize the rotary movements of the drive disk particularly well and simultaneously keeping the construction space small. The first bolt 21 is arranged on the edge of the drive disk 19. The second bolt 22 is located between the axis 20 and the first bolt 21 near to the first bolt 21. The third bolt 23 is arranged near to the axis 20. The axis 20 is located between the second bolt 22 and the third bolt 23. The drive disk 19 can be rotated around its axis 20 by a non-illustrated electrical drive.

There is a pivotable lever 24 with a T-shaped end which can be rotated around its axis 25. The axis 25 is attached to a latch plate or directly to the chassis. There are preferably also two stops 26 and 27 for the lever 24 with the T-shaped end which are attached to a latch plate or directly to the chassis. The stops 26 and 27 limit the pivoting movement of the lever with the T-shaped end 24.

The pivotable lever with the T-shaped end 24 limits rotary movements of the disk 19. Thus, in the illustrated open position the first bolt 21 of the drive disc 19 is adjacent to the T-shaped end of the lever 24. Consequently, the drive disc 19 can no longer be rotated in an anti-clockwise direction. In this position, the T-shaped end of the lever 24 preferably lies adjacent to the bolt-shaped stop 27 which ensures that the drive disk 19 can no longer be rotated in an anti-clockwise direction. Consequently, a mechanical end stop is attained.

There is a rod 28 with which the pawl 7 can be pivoted. The rod 28 is only sketched and suitably connected to the pawl 7 on the one hand and a drive on the other hand, for example, to the drive which is also capable of rotating the drive disk 19. The rod 28 can be pivotably connected with the pawl 7 with one end 29. Alternatively or additionally, the end 29 can be adjacent to a protrusion 30 of the pawl 7 in order to pivot the pawl 7 for example against a spring force out of a ratchet position. The pawl 7 can therefore be pre-tensioned in one execution form by a non-illustrated spring in such a way that this spring is capable of moving the pawl 7 into its ratchet position.

A brake element, damping element or stop 31 can be attached to the swing arm 5 which is capable of limiting or braking a pivoting of the catch 1 in a clockwise direction, at least temporarily.

There are microswitches 32, 33 and 34, with which positions of locking mechanism components can be detected. The position of the catch 1 is detected with a first microswitch 32 for example. The position of the drive disk 19 is detected with a second microswitch 33 for example. The position of the swing arm 5 is detected with a third microswitch 34, for example. However, other alternative or additional microswitches can be provided for which detect other positions and/or other components.

Furthermore, in FIG. 1, a locking bolt 35 is shown during latching of a pertaining hood which is attached to a non-illustrated hood of a motor vehicle. The locking bolt 35 has not yet reached the collecting arm 2 of the catch 1. The hood is still open.

The axes 4 and 8 of the catch 1 and pawl 7 are relatively near to the axis 6, the bearing point of the swing arm and thus relatively far from the end 15 of the swing arm 5 in order to thus provide a beneficial lever ratio.

If, starting from FIG. 1, the hood of the motor vehicle is further closed, the locking bolt 35 initially reaches the collecting arm 2 of the catch 1 and subsequently rotates the catch 1 in a clockwise direction until the load arm 3 of the catch 1 strikes the retaining lever 11. The thus associated impact is initiated via the retaining lever 11 into the swing arm 5. From here, the impact or the associated forces are conducted into the chassis on the one hand via the axis 6 of the swing arm 5 and on the other hand via the bracing lever 17. The drive disc 19 is thus protected from impact forces occurring during latching. Additionally, the collecting arm 2 can have attained the dampening element 31 in order to additionally conduct impact forces from the catch 1 into the swing arm 5. The catch 1 has attained a position which would enable the pawl 7 to be moved into its ratchet position. However, this is initially prevented by the rod 28. The hood gap is for example more than 10 mm, in particular 15 mm between the hood and headlight grille or radiator grille.

If the catch 1 reaches the position shown in FIG. 2, the microswitch 32 is thus activated, for example. Thus, the drive which is capable of driving or rotating the drive disk 19 can be set in motion. Whereupon the drive disk 19 rotates in a clockwise direction. The second bolt 22 thus reaches the bracing lever 17 and for example captures a protrusion of the bracing lever 17. Further rotation of the drive disc 19 in a clockwise direction therefore leads to the bracing lever 17 being pivoted out of its position shown in FIG. 2 in a clockwise direction. The underside of the arch-shaped end 15 of the swing arm 5 is supported meanwhile by the second bolt 22. A further rotation of the drive disk 19 in a clockwise direction results in the swing arm 5 being pivoted around its axis 6 in a clockwise direction and ultimately reaching the position shown in FIG. 3. This can be achieved by the latching movement of the door or flap or alternatively or additionally by gravity which impacts accordingly on a hood. A door or hood gap is decreased accordingly. The gap dimension is thus reduced to less than 10 mm, thus for example to 7 mm.

FIG. 3 clarifies that the lever with the T-shaped end meanwhile has loosened from the stop 27. This lever has, for example, been pivoted into the position shown in FIG. 3 due to gravity. It is significant that the catch 1 has still not been latched although the hood gap is still only a few millimeters, thus, for example, a maximum of 7 mm, preferably a maximum of 5 mm. This is for safety reasons as, for example, a finger cannot be trapped in the hood gap. Only when the hood gap is sufficiently small that fingers can no longer fit into the gap a further rotation of the drive disk 19 leads to the rod 28 being moved into a position which causes the pawl 7 to latch the catch 1. However, it can also be activated with attainment of the position shown in FIG. 3, for example the microswitch 33. Thus, a separate drive can be set in motion for the rod 28 which causes the pawl 7 to latch the catch 1 by relevant movement of the rod 28 as shown in FIG. 4.

As illustrated in FIGS. 3 and 4, the third bolt 23 of the drive disk 19 engages into the arch-shaped end 15 of the swing arm 5. The gap dimension is still several mm and is, for example, between 5 and 7 mm. A further rotation of the drive disk 19 in a clockwise direction results in the position shown in FIG. 5 ultimately being attained by closure. The third bolt 23 of the drive disk 19 which is meanwhile located within the arch-shaped end 15 of the swing arm 5 has pivoted the swing arm 5 around its axis 6 further in a clockwise direction. This can take place against a counter-pressure, such as the sealing pressure of a seal for the hood. Thus, the hood gap is further reduced without fearing the risk of injury. The gap dimension can thus have been reduced to less than 1 mm, thus for example to not more than 0.2 mm or not more than 0.1 mm.

Due to the control contour 14 the retaining lever 11 is pivoted out of its position retaining the catch 1 in a clockwise direction around its axis 12. The first bolt 21 of the drive disk 19 has struck the other side of the T-shaped end of the lever 24 of the relevantly pivotable lever and pivoted this lever around its axis 25 in an anti-clockwise direction. This pivoting movement is finally limited by attainment of the stop 26 as shown in FIG. 5. A further rotation of the drive disk 19 in a clockwise direction is then no longer possible. By provision of the pivoting lever with the T-shaped end 24 rotation of the drive disk 19 is limited on the one hand. On the other hand, especially large rotational angles of the drive disk are facilitated and in particular also rotational angles of more than 360°.

As the retaining lever 11 according to FIG. 5 is pivoted out of its retaining position, it is possible that the catch 1 is pivoted further in a clockwise direction, as shown in FIG. 6. This protects people who fall onto the pertaining hood, for example. The hood can thus be pushed further downwards in the area of the latch, without such a movement being blocked by the locking mechanism which reduces the risk of personal injury. So-called pedestrian protection can thus be achieved. The locking bolt 35 can in particular be moved by more than 10 mm, preferably by at least 20 mm further in the opposite direction to the opening direction. The latched catch can be pivoted away for this purpose by at least 10°, preferably by at least 20° from the opening position, as shown in FIG. 6.

The element 31 can be a plastic element with a predetermined breaking point. When, for example, snow is on the hood and the electrical drive lifts the hood, the plastic element prevents the catch from skidding downwards. The element 31 prevents undesirable skidding. The predetermined breaking point can break if a pedestrian falls onto the hood.

Alternatively, i.e. where the plastic element is not present a strong spring can be arranged on the catch which in turn is strong enough to lift the hood with a snow load.

An opening of the locking mechanism takes place vice versa accordingly.

REFERENCE SIGN LIST

1: Catch
2: Collecting arm
3: Load arm
4: Catch axis
5: Swing arm
6: Swing arm axis
7: Pawl
8: Pawl axis
9: Pawl ratchet surface
10: Catch ratchet surface
11: Retaining lever
12: Retaining lever axis
13: Stop or rotation limiting element for retaining lever
14: Control contour for retaining lever
15: Arch-shaped end of the swing arm
16: Pivotable end of a bracing lever
17: Bracing lever
18: Bracing lever axis
19: Drive disk
20: Drive disk axis
21: First bolt of the drive disk
22: Second bolt of the drive disk
23: Third bolt of the drive disk
24: Lever with T-shaped lever end
25: Axis for lever with the T-shaped end
26: Stop or rotation limiting element for the lever with the T-shaped end
27: Stop or rotation limiting element for the lever with the T-shaped end
28: Rod for pivoting of the pawl
29: Rod end on the pawl
30: Pawl protrusion
31: Brake element, damping element or stop for catch preferably with pre-determined breaking point
32: Microswitch
33: Microswitch
34: Microswitch
35: Locking bolt
36: Protrusion of the bracing lever

The invention claimed is:

1. A latching device for moving a flap of a motor vehicle toward a chassis of the motor vehicle from an open position to a closed position, the latching device comprising:

a locking mechanism consisting of a catch and pawl for ratcheting of the catch to move the flap into the closed position;

a swing arm to which the catch and the pawl are directly pivotably attached;

a drive that moves the swing arm which moves the locking mechanism to reduce a hood gap between the flap and the chassis before the catch is ratcheted by the pawl; and a retaining lever that is pivotably attached to the swing arm and engageable by the catch to retain the catch and prevent further movement of the catch before the catch is ratcheted.

2. The latching device according to claim 1, wherein the pawl can only latch the catch when the catch has been retained by the retaining lever.

3. The latching device according to claim 1, further comprising a control contour which is capable of pivoting the retaining lever out of a retaining position in which the retaining lever retains the catch.

4. The latching device according to claim 1, wherein the drive includes a drive disk and the swing arm is pivotable by the drive disk which includes a protruding first bolt with which rotational movements of the drive disk are limited.

5. The latching device according to claim 4, further comprising a stop for the swing arm formed as a mobile lever which has a T-shaped end.

6. The latching device according to claim 4, wherein the drive disk includes a protruding second bolt with which pivoting movements of the swing arm are controlled by the swing arm being supported on the protruding second bolt.

7. The latching device according to claim 6, wherein the drive disk includes a protruding third bolt, with which the swing arm is pivoted against counterpressure for reduction of the hood gap.

8. The latching device according to claim 7, wherein a pivoting of the swing arm is initially caused by the protruding second bolt and then by the protruding third bolt for reduction of the hood gap.

9. The latching device according to claim 6, further comprising a bracing lever which is capable of bracing the swing arm when an impact is conducted into the swing arm when the flap is moving from the open position to the closed position.

10. The latching device according to claim 9, wherein the protruding second bolt of the drive disk is capable of pivoting the bracing lever.

11. The latching device according to claim 1, wherein the catch and pawl are arranged close to an axis around which the swing arm can be pivoted.

12. The latching device according to claim 1, wherein when the catch is ratcheted by the pawl, the catch is pivoted away from the opening position.

13. The latching device according to claim 12, wherein the catch is pivotable away from a ratchet position in which the catch is ratcheted by the pawl by at least 10°.

14. The latching device according to claim 13, wherein the catch is pivotable away from the ratchet position by the pawl by at least 20°.

15. A latching device for moving a flap of a motor vehicle toward a chassis of the motor vehicle from an open position to a closed position, the latching device comprising:

a locking mechanism consisting of a catch and pawl for ratcheting of the catch to move the flap into the closed position;

a swing arm to which the catch and the pawl are directly pivotably attached; and a drive that moves the swing arm which moves the locking mechanism to reduce a hood gap between the flap and the chassis before the catch is ratcheted by the pawl, wherein the drive includes a drive disk having a protruding first bolt, a protruding second bolt, and a protruding third bolt, the protruding first bolt limiting rotational movements of the drive disk, the protruding second bolt supporting the swing arm to control pivoting movements of the swing arm, and the protruding third arm pivoting the swing arm against counterpressure for reduction of the hood gap.

* * * * *